United States Patent [19]

Tsukamoto et al.

[11] Patent Number: 4,716,687

[45] Date of Patent: Jan. 5, 1988

[54] METHOD AND APPARATUS FOR GRINDING A ROTARY BODY

[75] Inventors: Hidehiko Tsukamoto; Kanji Hayashi; Tsunetaka Sumomogi; Masashi Oya; Junichi Ibushi; Katsuaki Takasaki; Masao Arikawa; Tateo Tanimoto; Kunio Yamamoto; Kanehisa Miyaguchi; Yoshiki Mito; Tamenari Doho, all of Hiroshima, Japan

[73] Assignee: Mitsubishi Jukogyo Kabushiki Kaisha, Tokyo, Japan

[21] Appl. No.: 825,265

[22] Filed: Feb. 3, 1986

[30] Foreign Application Priority Data

Feb. 22, 1985 [JP] Japan ..... 60-34007
Apr. 12, 1985 [JP] Japan ..... 60-76648

[51] Int. Cl.[4] ..... B24B 5/04
[52] U.S. Cl. ..... 51/131.1; 51/289 R
[58] Field of Search ..... 51/131.1, 56 R, 289 R, 51/54 R

[56] References Cited

U.S. PATENT DOCUMENTS 1,394,704 10/1921 Barnhart ..... 51/56

*Primary Examiner*—Frederick R. Schmidt
*Assistant Examiner*—Robert A. Rose
*Attorney, Agent, or Firm*—Wenderoth, Lind & Ponack

[57] ABSTRACT

An improved method and apparatus for grinding a rotary body, in which a rotatably supported grindstone is positioned in such manner that an extension of a rotary axis of the grindstone does not intersect a rotary axis of the rotary body and the rotary axis of the grindstone is inclined with respect to a plane perpendicular to the rotary axis of the rotary body to be ground. The rotary body to be ground is rotatably driven, and the grindstone is pressed against the outer circumferential surface of the rotary body to be ground in order that the outer circumferential surface of the rotary body to be ground can be ground by a relative slip produced at a contact point between the outer circumferential surface of the rotary body to be ground and the grindstone.

6 Claims, 18 Drawing Figures

METHOD AND APPARATUS FOR GRINDING A ROTARY BODY

BACKGROUND OF THE INVENTION

1. Field of the Invention

The present invention relates to a method and an apparatus for grinding a rotary body, and more particularly to such a method and apparatus which can be favorably employed for on-line grinding of a work roll in a rolling mill such as a hot rolling mill or the like.

2. Description of the Prior Art:

In the case where a web such as a steel plate or the like is subjected to hot rolling in a rolling line in which a large number of rolling mills are disposed in series, a work roll has a large tendency to wear compared to a backup roll. In particular, wear and surface roughening of a web-passage portion of the work roll coming into contact with a web are tremendous, and local wear of its portions corresponding to side edge portions of a web is remarkable. Hence, during rolling operation of webs, rolling was effected while regulating a sequence of widths of webs to be rolled such that rolling operations could be sequentially shifted from rolling of broad width webs to rolling of narrow width webs, the work roll was replaced periodically and after the worn work roll had been ground externally of the rolling mill, it was again assembled in the rolling mill to be used for further rolling operations.

However, in the above-mentioned process of carrying out the scheduled rolling in which a sequence of widths of webs is regulated so that rolling operations are effected sequentially from rolling of broad width webs to rolling of narrow width webs and the work roll is ground externally of a rolling line, a production efficiency is deteriorated due to constraints in the sequence of rolling operations moreover much labor is necessitated because the frequency of replacing the work roll is high. These deficiencies are a great cause of the lowering of an availability factor of an installation. Therefore, development of an on-line grinding method and an apparatus therefor in which grinding of a roll is carried out during the rolling operation while the roll remains assembled in a rolling mill, a period between roll replacements is prolonged, and rolling operations which are not retricted in their sequence by widths of webs, has been advanced.

Among the above-referred on-line grinding apparatuses in the prior art, apparatuses of the type shown in FIGS. 4(*a*), 4(*b*) and 10 to 12 are well known. More particularly, in the apparatus shown in FIG. 4(*a*), grinding is effected by pressing a rectangular-column-shaped block-like grindstone 1 against a work roll 2 that is being rotated. Also, in the apparatus shown in FIG. 4(*b*), grinding is effected by rotating a disc-shaped grindstone 3 by means of a motor not shown and pressing this rotating grindstone 3 against a circumferential surface of a work roll 2.

In the grinding apparatus employing the rectangular-column-shaped block-like grindstone 1 as illustrated in FIG. 4(*a*), while the structure is simple because there is no need to rotate the grindstone 1, there is a shortcoming in that since the grindstone 1 is not rotating, the grinding surface of the grindstone 1 is liable to be clogged by ground powder or to be baked, and moreover, since the grindstone 1 is rectangular-column-shaped, its corner portions are liable to be broken, hence its life is short and accidents are apt to be induced.

On the other hand, in the case of the grinding apparatus employing the disc-shaped grindstone 3 as illustrated in FIG. 4(*b*), while the life of the grindstone 3 is long and a grinding capability is excellent, since the grindstone 3 must be rotated, it is necessary to rotate a rotary shaft 4 of the grindstone 3 by means of a motor not shown. Accordingly, there is a shortcoming a that a large space along the longitudinal direction of the roll is necessitated, moreover in the case where a plurality of grindstones 3 are disposed, the distance between the adjacent grindstones 3 must be large, and it becomes impossible to grind the entire surface of the roll along its longitudinal direction.

In a grinding apparatus shown in FIG. 10, grinding is effected by pressing a rectangular-block-shaped grindstone 31 against a work roll 1' that is being rotated. In a grinding apparatus shown in FIG. 11, grinding is effected by positioning a grindstone shaft 5 of a disc-shaped grindstone 32 parallel to a work roll 1' and pressing the outer circumferential surface of the grindstone 32 against the work roll 1' that is being rotated, and in the illustrated example, a plurality of grindstones 32 are arrayed in the longitudinal direction of the work roll 1'. Furthermore, in a grinding apparatus shown in FIG. 12, grinding is effected by pressing an endless-belt-like grindstone 33 wound around a pair of rotating pulleys 4' against a work roll 1'.

In the case of the grinding apparatus employing the rectangular-block-shaped grindstone 31 as illustrated in FIG. 10, while the structure of the apparatus is simple because there is no need to rotate the grindstone 31, there is a shortcoming in that clogging of the grindstone 31 occurs frequently or the grindstone 31 is liable to be baked because the grindstone 31 is not rotating, and also that corner portions of the grindstone 31 are liable to be broken, resulting in a short life, because it is rectangular-block-shaped, and accidents are apt to be induced.

In the case of the grinding apparatus employing the disc-shaped grindstone as illustrated in FIG. 11, since the grindstone 32 is rotating, clogging would not occur, hence the life of the grindstone is long and a grinding capability is also excellent. However, in order to rotatably drive the grindstone 32 it is necessary to equip an electric motor not shown for driving the grindstone shaft 5, and therefore, there is a shortcoming in that a large space along the longitudinal direction of the work roll 1' is necessitated moreover in the case where a plurality of grindstones 32 are disposed, the distance between the adjacent grindstones must be kept large, and it would become impossible to grind the entire surface along the longitudinal direction of the work roll 1'.

Furthermore, in the case of the grinding apparatus employing the belt-like grindstone 33 as illustrated in FIG. 12, there is a shortcoming in that the grindstone is liable to wear and to be broken, and the apparatus is complex.

SUMMARY OF THE INVENTION

It is therefore one object of the present invention to provide an on-line grinding method and an on-line grinding apparatus which are free from the above-mentioned shortcomings inherent to the on-line grinding method and apparatus in the prior art.

A more specific object of the present invention is to provide a novel on-line grinding apparatus facilitating a novel on-line grinding method of grinding a work roll in a rolling mill in its assembled state, which is simple in structure, low in cost and yet has an excellent grinding capability.

According to one feature of the present invention, there is provided a method for grinding a rotary body, consisting of the steps of positioning a rotatably supported grindstone so that an extension of a rotary axis of the grindstone does not intersect a rotary axis of the rotary body to be ground and the rotary axis of the grindstone is inclined with respect to a plane perpendicular to the rotary axis of the rotary body to be ground, rotatably driving the rotary body to be ground, and pressing the grindstone against the outer circumferential surface of the rotary body to be ground, whereby the outer circumferential surface of the rotary body to be ground is ground by a relative slip produced at a contact point between the outer circumferential surface of the rotary body to be ground and the grindstone.

According to another feature of the present invention, an apparatus for grinding a rotary comprises means for positioning a rotatably supported grindstone so that an extension of a rotary axis of the grindstone does not intersect a rotary axis of the rotary body to be ground and the rotary axis of the grindstone is inclined with respect to a plane perpendicular to the rotary axis of the rotary body to be ground, means for rotatably driving the rotary body to be ground, and means for pressing the grindstone against the outer circumferential surface of the rotary body to be ground, whereby the outer circumferential surface of the rotary body to be ground is ground by a relative slip produced at a contact point between the outer circumferential surface of the rotary body to be ground and the grindstone.

According to still another feature of the present invention, there is provided an apparatus for grinding a rotary body, comprising a first group of rotatably supported grindstones disposed along the longitudinal direction of the rotary body to be ground on one side of a center in the longitudinal direction, the rotary body being rotatably driven, the rotary axes of the respective grindstones in the first group obliquely intersecting the axis of the rotary body to be ground, a second group of rotatably supported grindstones disposed along the longitudinal direction of the rotary body to be ground on the other side of the center in the longitudinal direction, the rotary axes of the respective grindstones in the second group obliquely intersecting the axis of the rotary body to be ground and inclined oppositely to the first group of grindstones, and means for moving the first and second groups of grindstones in the longitudinal direction of the rotary body while pressing the grindstones against the outer circumferential surface of the rotary body to be ground.

According to yet another feature of the present invention, there is provided a mill roll grinding apparatus of the type having a plurality of grinding body holders for pressing grinding bodies rotatably mounted at their tip ends against a roll surface, that are arrayed in the direction of a roll axis within a frame that can be reciprocated parallel to the roll axis, in which the grinding body is mounted within the holder with its rotary axis inclined in the direction towards the roll axis with respect to a normal line to the roll surface without intersecting the roll axis, and the frame is constructed so as to be elevated and lowered in response to variations of a vertical position and a diameter of the roll by means of an elevator driving device provided with an arithmetic processing unit on an input side of a drive motor.

The method and apparatus according to the present invention are essentially characterized by the above-mentioned features, and since the grindstone has its rotary axis positioned so as not to intersect the rotary axis of the rotary body and inclined with respect to the rotary axis of the rotary body, a relative slip and hence a sliding friction are produced between the grindstone and the outer circumferential surface of the rotary body to be ground that is rotationally driven, and the outer circumferential surface of the rotary body is automatically ground by this sliding friction. Accordingly, any drive source for rotatably driving the grindstone is unnecessary, yet the grindstone is rotated by the rotary body to be ground. Therefore, clogging of the grindstone does not occur, and even in the case where a plurality of grindstones are arrayed in the longitudinal direction of the rotary body to be ground along its outer circumferential surface, there is not need to reserve a sufficient space between the adjacent grindstones. Hence it has become possible to achieve a reduction in the installation cost and a serving in space.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 1(*b*) is a vertical cross-sectional view taken along line B—B in FIG. 1(*a*) as viewed in the direction of the arrows;

DESCRIPTION OF THE PREFERRED EMBODIMENTS

Figure 1A:
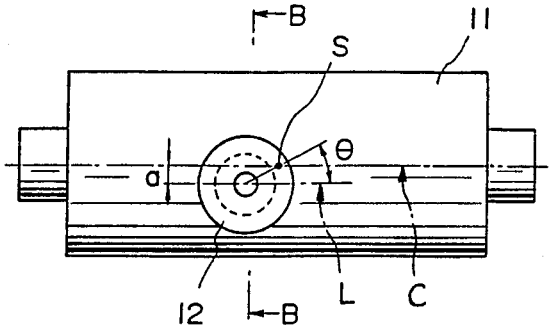
FIG. 1(*a*) is a schematic front view showing an operating state of one preferred embodiments of the present invention.
Figure 1B:
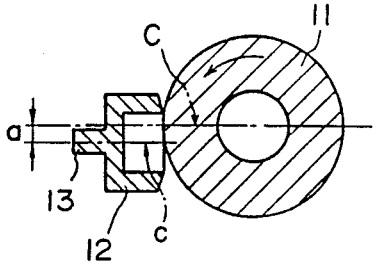
Figure 2:
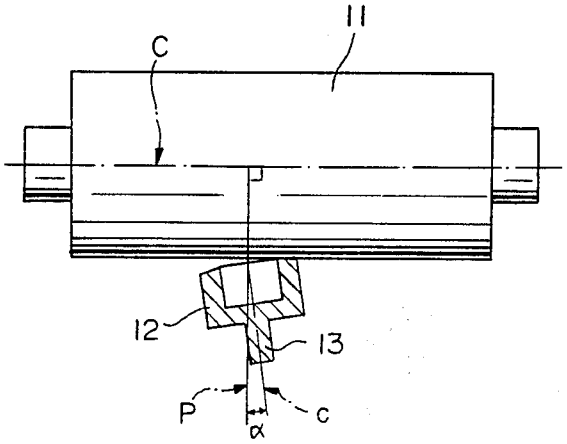
FIG. 2 is a plan view of the preferred embodiment shown in FIGS. 1(*a*) and 1(*b*)

Referring now to FIGS. 1(*a*) and 1(*b*) and FIG. 2 which illustrate one preferred embodiment of the method and apparatus for grinding a rotary body according to the present invention, a grindstone 12 pressed against an outer circumferential surface of a mill roll 11 is formed in a cylindrical shape in this preferred embodiment, and it is rotatably supported by a support member not shown so that it can be freely rotated about its rotary shaft 13. A rotary axis c of the grindstone 12 is offset with respect to a rotary axis C of the mill roll 11 by an amount a, so that an extension of the rotary axis c does not intersect the rotary axis C. In addition, the rotary axis c of the grindstone 12 is inclined by an angle $\alpha$ with respect to a plane p perpendicular to the rotary axis C of the mill roll 11, and accordingly, a contact point S between the outer circumferential surface of the mill roll 11 and the grindstone 12 is located at a position deviated by an angle $\theta$ with respect to a straight line L which passes through a cross-point between the rotary axis c and the outer circumferential surface of the mill roll 11 and is parallel to the rotary axis C, as best seen in FIG. 1(*a*).

Figure 3:
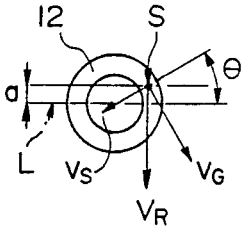
FIG. 3 is a diagramatic view showing a principle of grinding of the preferred embodiment shown in FIGS. 1(*a*), (*b*) and 2.
Figure 4A:
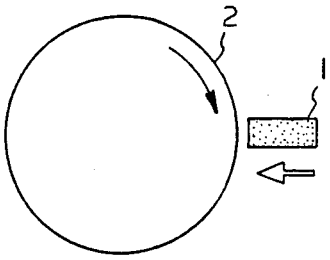
FIGS. 4(*a*) and 4(*b*) are schematic side views respectively showing different methods for grinding a work roll in the prior art.
Figure 4B:
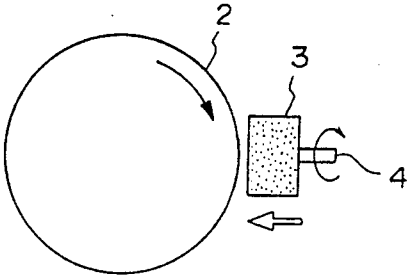

Accordingly, as shown in FIG. 3, if the mill roll 11 is rotatably driven at a circumferential velocity $V_R$, then the grindstone 12 is rotated at a circumferential velocity $V_G$ that is represented by the following equation:

$$V_G = V_R \cdot \cos\theta.$$

At this moment, if a velocity component of the circumferential velocity $V_R$ of the mill roll 11 at the contact point S in the direction towards the rotary axis c is represented by $V_S$, then a slip equal to $V_S$ is produced between the mill roll 11 and the grindstone 12, which is represented by the following equation:

$$V_s = V_R \cdot \sin\theta,$$

and since displacement of the grindstone 12 in the direction of $V_s$ is prevented by the support member therefor, the outer circumferential surface of the roll mill 11 is ground by a sliding frictional force corresponding to this slip. In this case, it is only required to adjust the inclination angle $\alpha$ and the amount of offset a of the grindstone 12 so that the angle $\theta$ may take an optimum value in view of a grinding efficiency as well as a degree of clogging of the grindstone 12.

It is to be noted that while the above-described embodiment of the present invention was explained in connection to the case where a mill roll in a rolling mill is to be ground, it is a matter of course that the present invention can be widely applied to grinding of outer circumferential surfaces of other rotary bodies.

Figure 5:
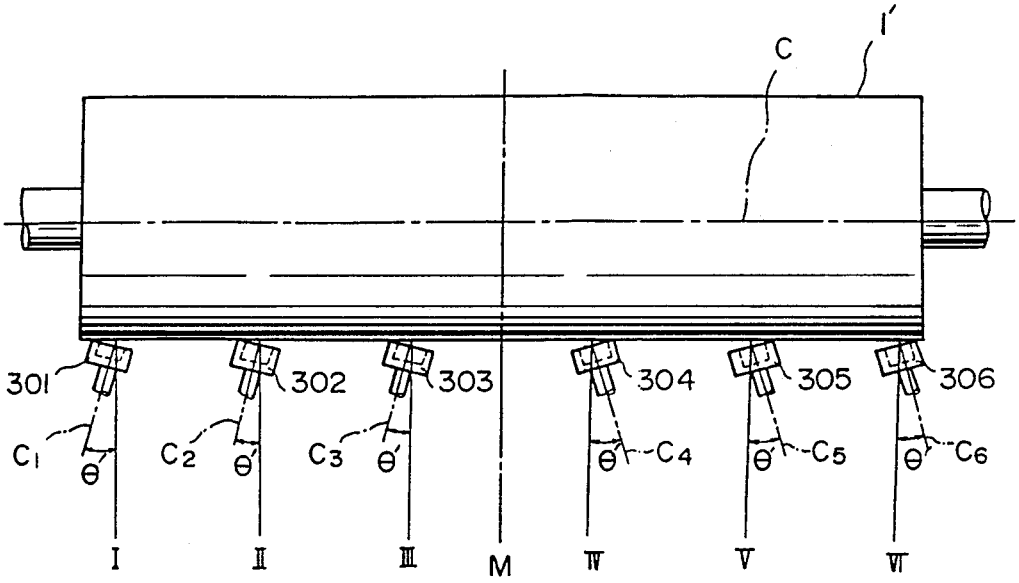
FIG. 5 is a schematic plan view showing an apparatus for grinding a rotary body according to another preferred embodiment of the pressent invention.

In an apparatus for grinding a rotary body according to a second preferred embodiment of the present invention, rotatably supported grindstones are disposed along a longitudinal direction of a rotary body, and a structure and an arrangement of the apparatus are such that a plurality of (six, in the illustrated embodiment) cylindrical grindstones 301, 302, 303, 304, 305 and 306 are disposed along a longitudinal direction of a work roll 1', as shown in FIG. 5. Rotary axes $C_1$, $C_2$, $C_3$, $C_4$, $C_5$, and $C_6$ of the respective grindstones 301 to 306 obliquely intersect a rotary axis C of the work roll 1', and an angle $\theta'$ formed between these rotary axes of the grindstones 301 to 306 and a plane perpendicular to the rotary axis C of the work roll 1' is set in opposite directions between the grindstones 301 to 303 on one side of a center M in the longitudinal direction of the work roll 1' and the grindstones 304 to 306 on the other side of the center M. In other words, a first group of grindstones 301 to 303 and a second group of grindstones 304 to 306 are disposed and directed in such directions so that their respective contact and surfaces may be opposed to each other. Under the thus disposed condition, the respective grindstones 301 to 306 are respectively reciprocated between positions I and II, between positions II and III, between positions III and M, between positions M and IV, between positions IV and V and between positions V and VI on the outer circumferential surface of the work roll 1 by means of a moving device not shown, while they are respectively rotated, and thereby the outer circumferential surface of the work roll 1' can be ground by these grindstones 301 to 306.

Figure 8:
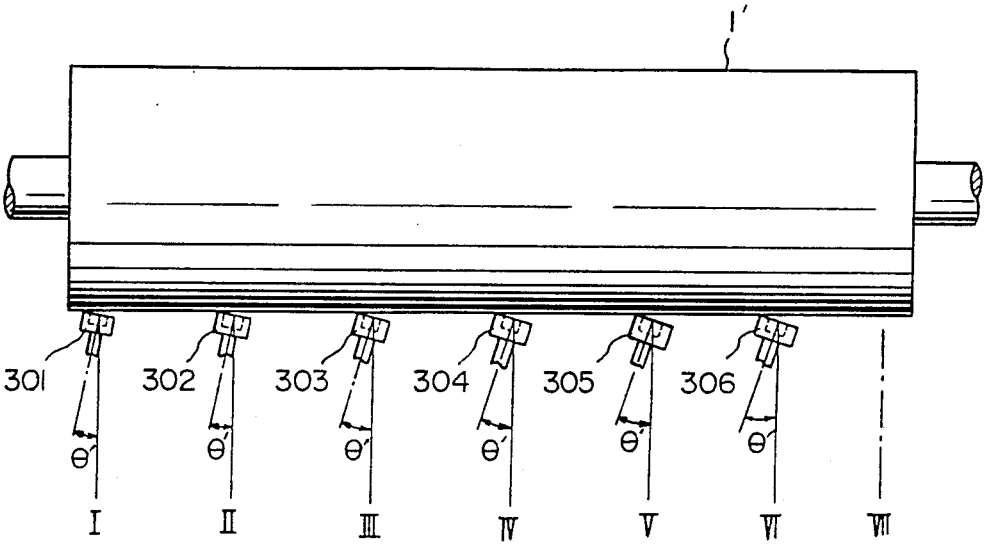
FIG. 8 is a schematic plan view showing one example of an apparatus for grinding a rotary body according to the present invention, in which the rotary axes of all the grindstones are inclined in the same direction.
Figure 9:
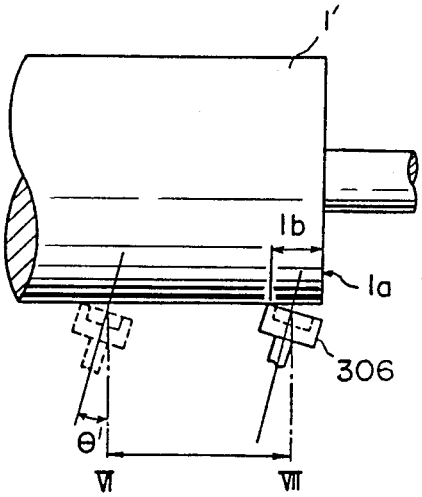
FIG. 9 is an enlarged schematic plan view showing a state of grinding a side edge portion of the same rotary body.
Figure 10:
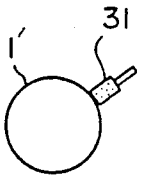
FIGS. 10 to 12 are schematic views respectively showing different on-line grinding apparatus in the prior art.
Figure 11:
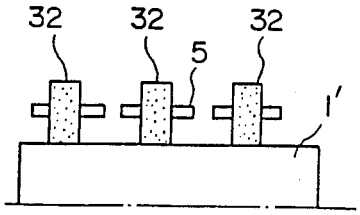
Figure 12:
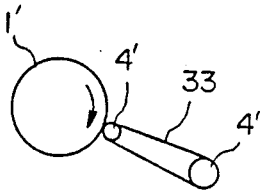

Now, if the grindstones 301 to 306 are disposed as inclined in the same direction, for example, as shown in FIG. 8, then while the respective grindstones 301 to 306 grind the outer circumferential surface of the work roll 1' while reciprocating between positions I and II, between positions II and III, between positions III and IV, between positions IV and V, between positions V and VI and between positions VI and VII, respectively, and when the grindstone 306 at the right end as viewed in FIG. 8 has reached the right side edge of then the work roll 1', the grindstone 306 would project from the right side edge of the work roll 1'. This results in not only the projection of the grindstone 306 itself but also projection of a rotating mechanism such as a rotary shaft 6 of the grindstone and a rotation suppressor therefor, and these would come into contact with a main body of a rolling mill such as a housing and the like. Therefore, excessive projection from the side edge of the work roll 1 cannot be admitted. From such reasons, if the grindstone 306 is held so as not to project from a side edge 1*a* of the work roll 1', a neighbor portion 1*b* of the side edge would be left unground.

However, according to the second preferred embodiment of the present invention, since the grindstones 301 to 306 are arrayed as shown in FIG. 5, the work roll 1' can be ground up to its side edges on the both sides, the grindstones 301 and 306 positioned at the opposite ends would not project from the side edges of the work roll 1', nor would the rotating mechanism strike against the main body of the rolling mill, and hence uniform grinding can be effected over the entire length in the longitudinal direction of the work roll 1'.

It is to be noted that while the above-described embodiment was explained with respect to an apparatus employing cylindrical grindstones, the present invention should not be limited to such grindstones, but is also applicable with conical grindstones. Moreover, the apparatus for grinding a rotary body according to the present invention is available not only as an on-line grinding apparatus for a work roll in a hot rolling mill, but also for grinding of various rotary bodies such as pinch rolls, moving rollers backup rolls, or rolls in a cold rolling mill.

Figure 6:
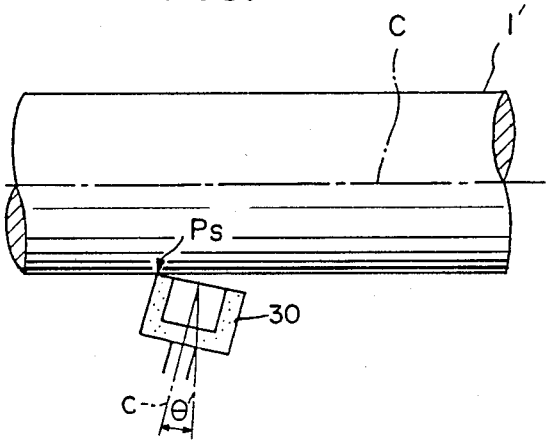
FIG. 6 is a schematic plan view showing a principle of grinding according to the preferred embodiment shown in FIG. 5.
Figure 7:
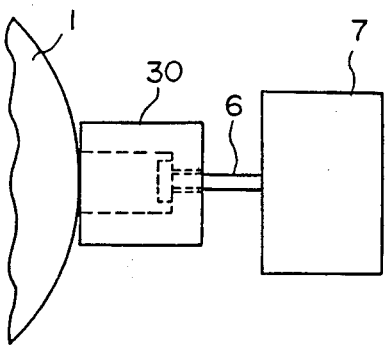
FIG. 7 is a schematic partial side view also showing the principle of grinding according to the preferred embodiment shown in FIG. 5.

A grinding principle of the apparatus for grinding a rotary body according to the second preferred embodiment of the present invention is such that grinding is effected by pressing an end surface of a grindstone 30 having a rotary axis c intersecting a rotary axis C of a work roll 1' that is rotatably driven, against the circumferential surface of the work roll 1 as shown in FIG. 6, and in the illustrated example, a cylindrical grindstone is employed as the grindstone 30. In the case where a cylindrical grindstone 30 is used in the above-described manner, the contact portion $P_S$ between the grindstone 30 and the work roll 1' becomes close to point contact, hence there is an advantage that a force for pressing the grindstone 30 against the work roll 1' can be made small, that is not only advantageous in view of rigidity of the apparatus but would hardly result in baking of the grindstone 30, and moreover, a small-sized rotational driving device can suffice. The reason why the rotational driving device can be made small is due to the fact that since the rotary axis c of the grindstone 30 is inclined by an angle $\theta'$ with respect to a plane perpendicular to the rotary axis C of the work roll 1' to make the end surface of the grindstone 30 come into partial contact with the outer circumferential surface of the work roll 1', the grindstone is forcibly rotated accompanying the rotation of the work roll 1', and hence a driving device for the grindstone 30 becomes unneccessary. However, if the grindstone rotates at the same circumferential velocity as the work roll 1', grinding would be hardly effected, and so, at the contact portion $P_S$, a relative slip must be produced between the work roll 1' and the grindstone 30. To that end, as shown in FIG. 7, a rotary shaft 6 of the grindstone 30 is connected to a rotation suppressor 7 containing, for example, oils having a high viscosity or a braking device therein so that the forced rotation of the grindstone 30 can be regulated by a resistance of the rotation suppressor 7, and thereby a relative slip is produced between the grindstone 30 and the work roll. As a matter of course, the grindstone 30 could be driven by an electric, hydraulic or pneumatic motor without employing the above-mentioned rotation suppressor 7.

Now, a construction of a mill roll grinding apparatus according to a third preferred embodiment of the present invention will be explained in detail with reference to FIGS. 13 to 16.

Figure 14:
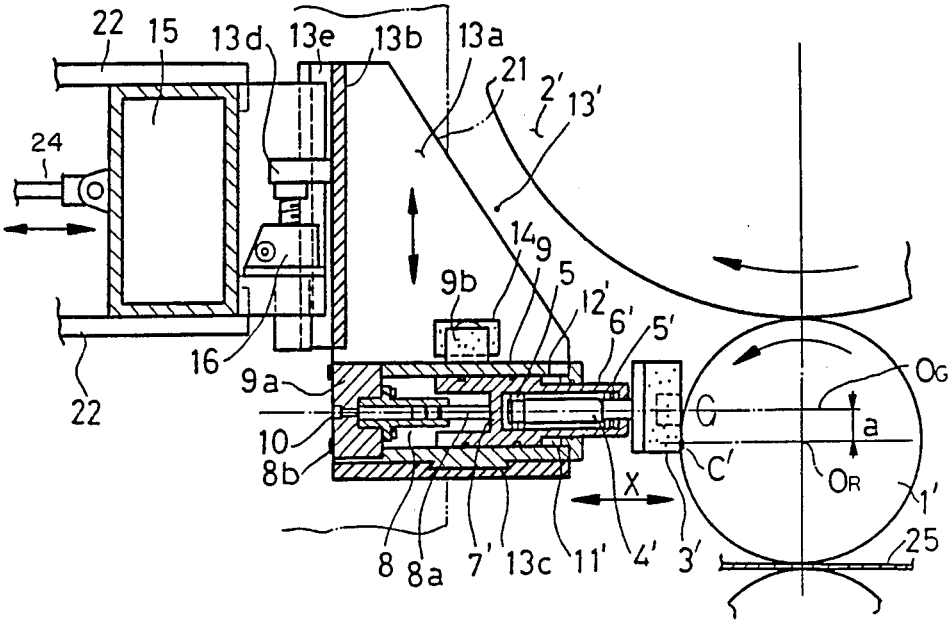
FIG. 14 is a cross-sectional view of the apparatus of FIG. 13 taken along line A—A as viewed in the direction of the arrows.

As shown in FIG. 14, a rolling mill operates to roll a rolled sheet material 25 by means of a work roll 1', which is reinforced by a backup roll 2'. Grinding bodies 3' such as cylindrical or rod-shaped grindstones arrayed in along an axial direction of the work roll 1', are rotatably supported individually at tip end portions of grinding body holders 6' via shafts 4' and bearings 5', respectively. In the illustrated embodiment, the grinding body 3' is a cylindrical grindstone, and so, in the following description, the grinding body 3' will be described as as grindstone 3', and the grinding body holder 6' will be described as a grindstone holder 6'.

Each grindstone holder 6' forms a plunger. A partition wall 7' at the rear portion of the plunger is connected to a pressing device 8 consisting of a plunger **8*a* and a cylinder 8*b*, and is fitted in a frame 9 so as to be advanced and retracted in the directions of arrows X. Each pressing device 8 is mounted to an inside of a rear cover 9*a* of the frame, and by feeding an actuating oil to the cylinder 8*b* through a hole 10 via a hydraulic pressure control valve not shown, the grindstone 3' can be pressed against the surface of the work roll 1' at any arbitrarily set pressing force. It is to be noted that the frame 9 is provided with an oil feed port 12' leading to a pull-back cylinder chamber 11'** for a grindstone holder.

Figure 13:
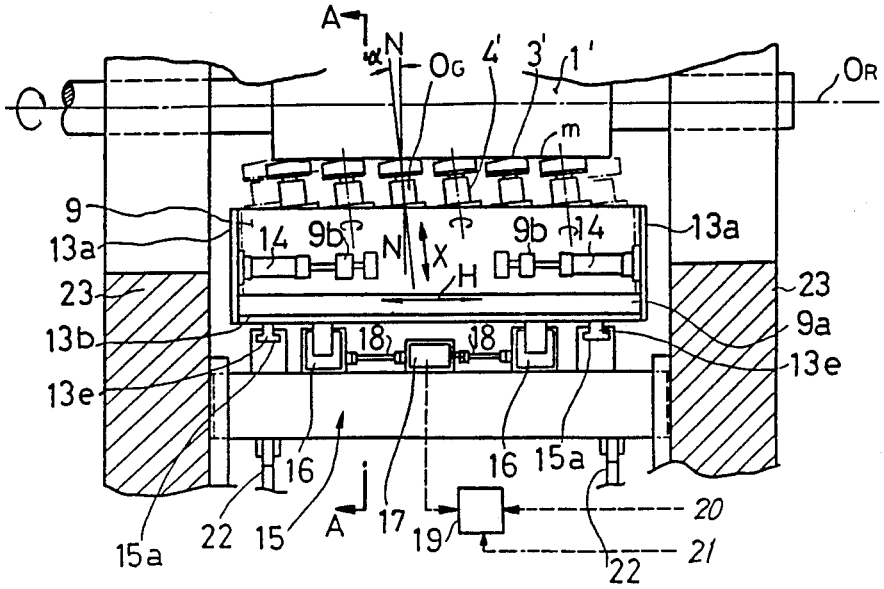
FIG. 13 is a plan view showing a mill roll grinding apparatus according to still another preferred embodiment of the present invention.
Figure 15:
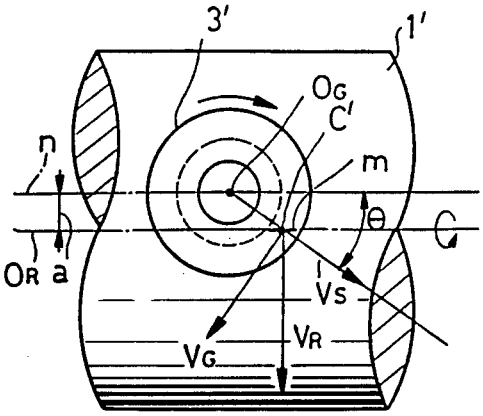
FIG. 15 is a diagrammatic view showing the state of contact between a grindstone and a work roll to be ground.
Figure 16:
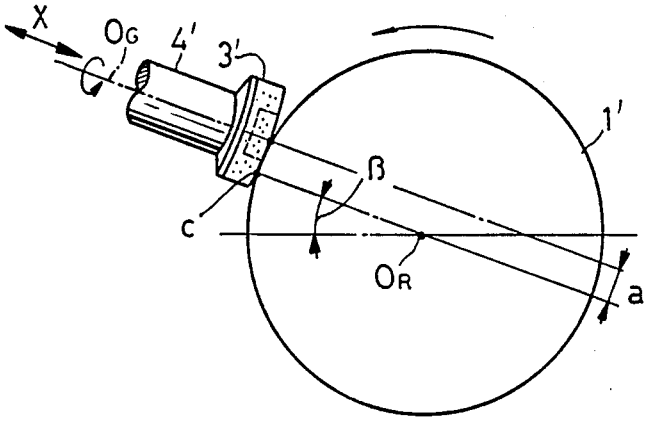
FIG. 16 is a schematic side view showing the state of contact between the grindstone and the work roll to be ground in the case where the rotary axis of the grindstone is inclined with respect to the horizontal plane.

Each grindstone holder 6' is mounted within the frame 9 with a rotary axis $O_G$ of its grindstone 3' inclined at any arbitrarily set angle $\alpha$ with respect to a normal line N of the outer circumferential surface of the work roll 1' in the direction towards the rotary axis of the work roll 1' as shown in FIG. 13, and also the rotary axis $O_G$ of the grindstone 3' is offset on the upside or on the downside with respect to the rotary axis $O_R$ of the work roll 1'. FIGS. 14, 15 and 16 illustrate the case where the rotary axis $O_G$ of the grindstone 3' is offset on the upside by a preset value a.

FIG. 15 is a diagrammatic view showing a contact state between a grinding body 3' and the work roll 1'. If the rotary axis $O_G$ of the grindstone 3' is offset with respect to the rotary axis $O_R$ of the grinding body 3', then during grinding, a contact portion between the tip end surface of the grindstone 3' and the work roll 1', that is, the grinding surface would become line contact parallel to the rotary axis $O_R$ of the work roll 1' as indicated by reference character m in this figure, and a center point C' of the contact line m is placed at a position making an angle $\theta$ with respect to a straight line n that passes through a center $O_G$ of rotation of the grindstone 3' and that is parallel to the rotary axis $O_R$ of the work roll 1'. It is to be noted that during grinding, the work roll 1' rotates at a circumferential velocity $V_R$, while the grindstone 3' rotates at a circumferential velocity $V_G$, and hence, a relative slip velocity $V_S$ is produced between the grindstone 3' and the work roll 1' as best seen in FIG. 15.

Now, the frame 9 can be reciprocated in the axial directions H of the work roll 1' along a guide groove **13*c* in a frame support table 13' by pressing a pair of protrusion members 9*b* above the frame 9 by actuation of a pair of cylinders 14 mounted on the opposite side walls 13*a* of the frame support table 13. In addition, the frame support table 13' is connected to a pair of elevating and lowering devices such as, for example, motor screw jacks 16 or the like mounted to the support beam 15 via a pair of brackets 13*d* projecting from the opposite side portions of a rear wall 13*b*. Also the frame support 13' is disposed so as to be movable in the vertical directions along guide grooves 15*a* in the support beam 15 by means of guide members 13*e* provided on the rear wall 13*b*** and extending in the vertical direction.

The elevating and lowering devices 16 are driven by a driving motor 17 and drive shafts 18, and the motor 17 is connected to an output side of an arithmetic unit 19. To the arithmetic unit 19 are input a roll depressing signal 20 of a roll gap setting device not shown and a work roll diameter 21, thereby a desired amount of elevation or lowering of the grindstone 3' is calculated and output, and the jack 16 is driven by the motor 17 on the basis of the output signal.

In addition, guide members 22 for guiding the above-mentioned support beam 15 are fixedly provided on a housing 23 of a rolling mill, and also, for the purpose of moving the grinding apparatus upon reassembling the rolls, a moving cylinder 24 is connected to the support beam 15.

While the grindstones 3' and their rotary axes 4' are arrayed horizontally in the apparatus according to the third preferred embodiment explained with reference to FIGS. 13 and 14, in this case resonant vibration of the grindstone 3' caused by grinding resistance upon grinding is liable to be generated, and so, it is desirable to mount the grindstones 3' with their axes 4 inclined upwards or downwards by an appropriate angle with respect to the horizontal plane as shown in FIG. 16. In the illustrated example, the grindstones 3' are mounted to be directed obliquely upwards by an angle $\beta$.

On the other hand, with respect to a grinding apparatus for a lower work roll, through not shown, since the construction is identical to that in the case of an upper work roll, except that the rotary axis 4' of the grindstone 3' is made offset downside with respect to the axis of the lower work roll so that the position of the contact portion m between the lower work roll and the grindstone 3' is upside of the center of rotation of the grindstone 3' oppositely to the case of the upper work roll 1', and that the grindstone 3' is mounted as inclined downwards by an appropriate angle $\beta'$ with respect to the horizontal plane, and therefore, further description thereof will be omitted.

In order to grind a roll by means of the apparatus according to the present invention constructed as described above, at first the grindstone 3' is elevated or lowered by the jack 16 to make its rotary axis $O_G$ offset with respect to the rotary axis $O_R$ of the work roll 1' either upwards or downwards by a desired set value a, and thereafter while the grindstone 3' is pressed against the work roll 1' that is rotating at a predetermined circumferential velocity $V_R$ with a predetermined set pressure by means of the pressing device 8, the grindstone 3' is reciprocated in the axial direction of the work roll 1'. Then, the surface of the work roll 1' is ground as a result of a relative slip velocity $V_S$ between the grindstone 3' and the work roll 1' while line contact m is always maintained between the grinding surface of the grindstone 3' and the surface to be ground of the work roll 1'. In this instance, the inclination angle $\alpha$ and the amount of offset a of the rotary axis of the grindstones 3' are adjusted in view of the circumferential velocity $V_R$ of the work roll 1', a grinding efficiency of the grindstone 3' and a frequency of cloggings, so that the angle $\theta$ which determines the ratio of the circumferential velocity $V_G$ of the grindstone 3' to the relative slip velocity $V_S$ may take an optimum value.

On the other hand, since the position of the contact portion m of the grinding surface of the grindstone 3' varies due to the facts that the diameter of the work roll 1' is successively reduced by grinding and that a roll gap is varied as a result of thickness change of the rolled sheet material 25, prior to grinding it is necessary to the grinding position, set that is, the amount of offset a accurately, each time by vertically moving and advancing to and retracting from the work roll surface the grindstone 3'. In this case, a roll depressing signal 20 issued from a roll gap setting device not shown and a work roll diameter 21 are input to the arithmetic unit, and on the basis of an output signal from the arithmetic unit 19 the jack 16 is elevated or lowered and the pressing device 8 is actuated to press the grindstone 3' against the work roll 1', and thereby, the grindstone 3' can be automatically set at a predetermined precise grinding position.

While the present invention has been described above in connection to preferred embodiments of the invention, it is a matter of course that the present invention should not be limited to only the illustrated embodiments, but many changes and modifications in design could be made without departing from the spirit of the present invention.

What is claimed is:

1. A method for on-line grinding of a work roll that is rotatably supported about a rotational axis thereof in a rolling mill, said method comprising:

positioning a rotatably supported grindstone having an axis of rotation against the outer circumferential surface of the work roll such that the axis of rotation of the grindstone extends in a direction that does not intersect the rotational axis of the work roll, and such that the axis of rotation of the grindstone intersects a plane extending perpendicular to the rotational axis of the work roll at a predetermined angle;

rotating the work roll about the rotational axis thereof; and continuously urging the grindstone toward the outer circumferential surface of the work roll as the work roll is rotated and causing a relative slip between the rotating work roll and the grindstone to occur at a contact point therebetween thereby causing said grindstone to grind the work roll continuously as the grindstone wears and the work roll is ground.

2. The method as claimed in claim 1, and further comprising continuously osscilating the grindstone in the direction in which the rotational axis of the work roll extends as the work roll is rotated.

3. An apparatus for on-line grinding of a work roll as the work roll is rotated about a rotational axis thereof in a rolling mill, said apparatus comprising:

a grindstone rotatably supported about an axis of rotation thereof;

positioning means for positioning said rotatably supported grindstone against the outer circumferential surface of the work roll and such that the axis of rotation of said grindstone extends in a direction that does not intersect the rotational axis of the work roll and such that the axis of rotation of said grindstone intersects a plane extending perpendicular to the rotational axis of the work roll at a predetermined angle; and means for continuously urging said grindstone toward the outer circumferential surface of the work roll as the work roll is rotated and causing a relative slip between the rotating work roll and said grindstone at a contact point therebetween for causing said grindstone to grind the work roll continuously as said grindstone wears and the work roll is ground.

4. An apparatus as claimed in claim 3, and further comprising osscilating means for osscilating said grindstone in the direction in which the rotational axis of the work roll extends as the work roll is rotated.

5. An apparatus for on-line grinding of a work roll as the work roll is rotated about a rotational axis thereof in a rolling mill, said apparatus comprising:

a plurality of grindstones each of which is rotatably supported about respective axes of rotation thereof, said plurality of grindstones spaced from one another in a direction extending parallel to the rotational axis of the work roll;

a plurality of grindstone holders each of which is associated with and operatively connected to a respective one of said grindstones for continuously urging the grindstones toward the outer circumferential surface of the work roll as the work roll is rotated and causing a relative slip between the rotating work roll and said grindstones at a contact point therebetween for causing said grindstones to grind the work roll continuously as the grindstones wear and when the work roll is ground;

a movable frame on which said plurality of grindstones are mounted such that said axes of rotation of said grindstones extend in a direction that does not intersect the rotational axis of the work roll and such that said axes of rotation of said grindstones each intersect a plane extending perpendicular to the rotational axis of the work roll at a predetermined angle;

elevating and lowering means connected to said frame for moving said frame in opposite directions which are perpendicular to the direction in which said grind stones are continuously urged against the outer circumferential surface of the work roll by said grindstone holders and said opposite directions also being perpendicular to the direction in which the rotational axis of the work roll extends; and an elevator driving device operatively connected to said elevating and lowering means for driving said elevating and lowering means to move said frame in said opposite directions.

6. An apparatus as claimed in claim 5, wherein said elevator driving device comprises a drive motor operatively connected to said elevating and lowering means, and an arithmetic driving unit operatively connected to said drive motor for operating said drive motor to move said frame in response to input signals indicative of the diameter of the work roll and the relative position of said grindstones in said opposite directions to the work roll to position said grindstones against the work roll.

* * * * *